US005794843A

United States Patent [19]

Sanchez

[11] Patent Number: 5,794,843

[45] Date of Patent: Aug. 18, 1998

[54] CUP WRAP

[76] Inventor: Rafael S. Sanchez, 7486 La Jolla Bl, La Jolla, Calif. 92037

[21] Appl. No.: 745,852

[22] Filed: Nov. 8, 1996

[51] Int. Cl.[6] ..... B65D 3/28

[52] U.S. Cl. ..... 229/403; 220/903

[58] Field of Search ..... 229/403; 220/671, 220/755, 753, 756, 772, 739, 903

[56] References Cited

U.S. PATENT DOCUMENTS

| | | | |
|---|---|---|---|
| 3,908,523 | 9/1975 | Shikaya | 229/403 |
| 4,998,666 | 3/1991 | Ewan | 229/102 |
| 5,205,473 | 4/1993 | Coffin, Sr. | 229/403 |
| 5,259,529 | 11/1993 | Coale | 220/903 X |
| 5,425,497 | 6/1995 | Sorenson | 229/403 X |
| 5,458,723 | 10/1995 | Watkins et al. | 229/117.23 X |
| 5,469,983 | 11/1995 | Yawata | 220/753 X |

*Primary Examiner*—Steven M. Pollard

[57] ABSTRACT

Corrugated cup wraps which are made of recyclable material that are held adhesively to cups without encircling the entire circumference of the cups. The cup wraps are made of a corrugated material that is fluted for air ventilation which facilitates the quality of a thermal barrier between the cup and the hand holding the cup wrap-wrapped cup. These cup wraps are flexible and easy to wrap around paper cups and attach to paper cups when the paper cups have a minimum circumference equal to the length of the cup wraps. To use each cup wrap, simply peel back and remove a paper liner to expose an aggressively adhesive surface and attach the cup wrap to a paper cup. The secure adhesive attachment to the cup allows the cup wrap to be of a single size, but still fit a wide range of cup sizes. The adhesive attachment quality of these cup wraps make these cup wraps better than other cup holders because other cup holders require the user to fully wrap the cups, but do not attach securely to the cups.

12 Claims, 1 Drawing Sheet

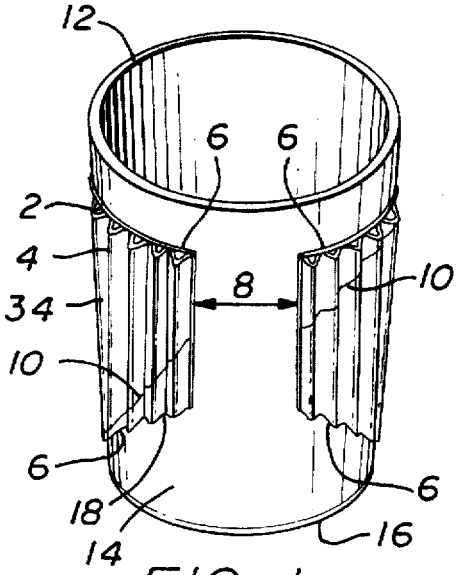
FIG. 1
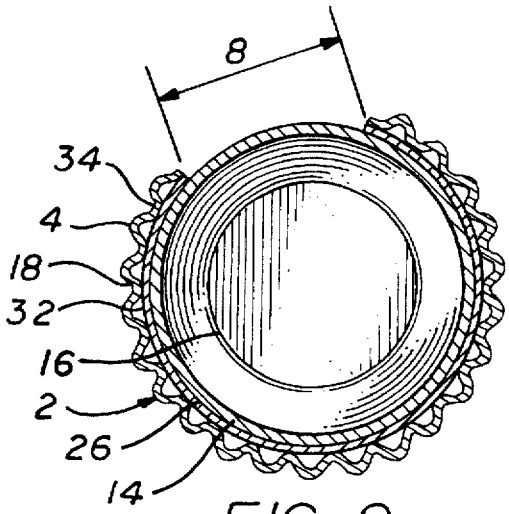
FIG. 2
FIG. 3
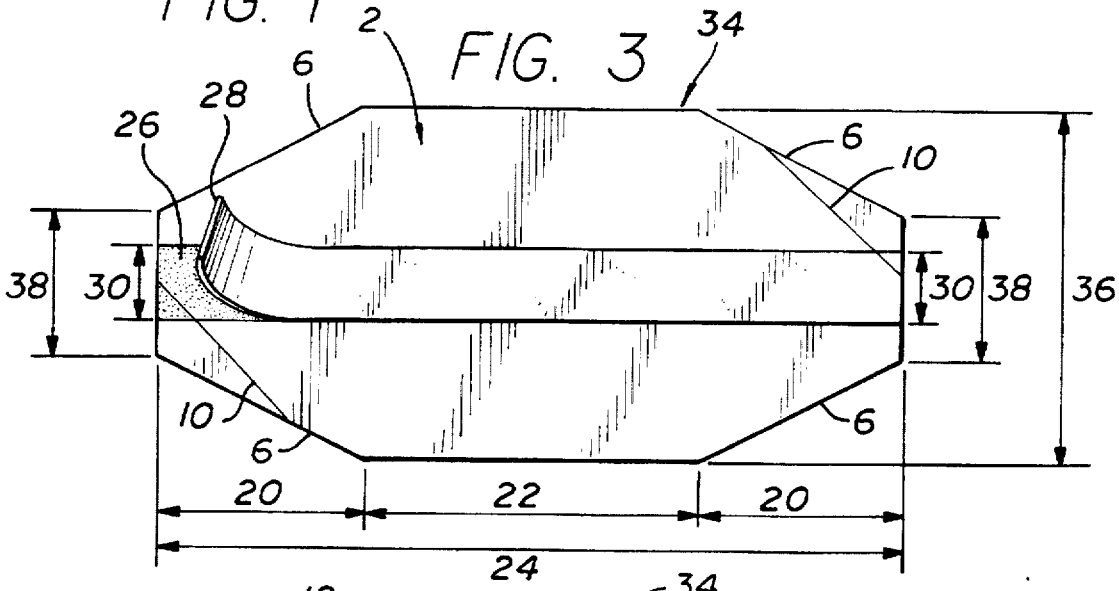
FIG. 4
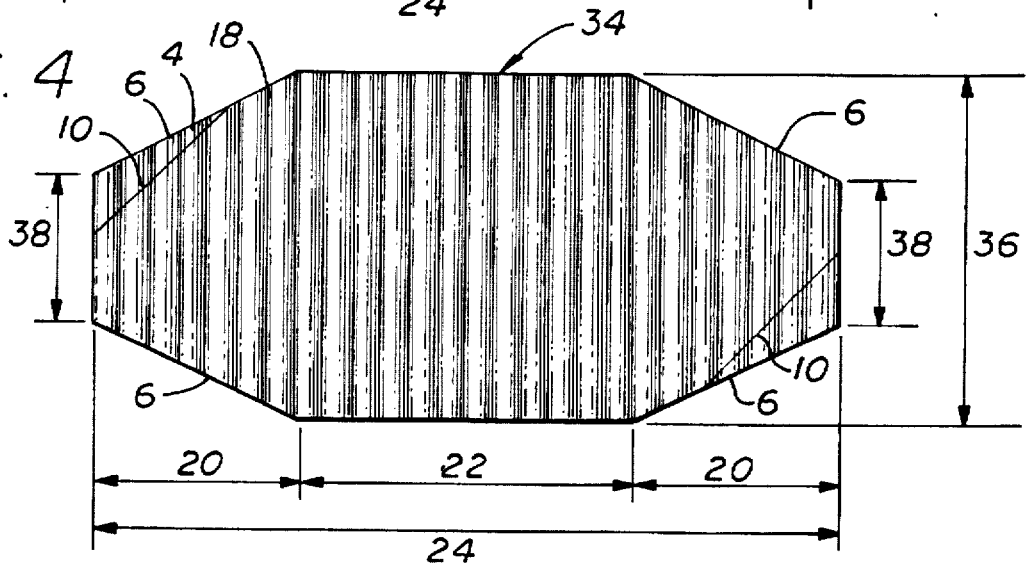

CUP WRAP

FIELD OF THE INVENTION

This invention relates to insulating cup holders, especially those which are made of recycled and recyclable paper products.

BACKGROUND OF THE INVENTION

This new invention has been conceived because of the clear need for a more effective thermal barrier device to allow a person to hold paper cups filled with hot or cold beverages. Existing cup holders such as the cup holders described in U.S. Pat. Nos. 5,425,497, 5,102,036 and 5,205,473 each completely encircle the paper cup and provide a thermal barrier for the person holding the cup, but is impractical in general use because it can easily slip off the cup, does not fit all common cup sizes and cannot be easily used in conjunction with automobile beverages holders. My invention attaches with a user-exposed adhesive strip to paper cups, forming a thermal barrier patch around a paper cup of any common size. Larger cups simply have a greater area of their circumference left uncovered by the cup wrap than smaller cups. This lends to the advantage of having one cup wrap size fitting virtually any common cup size. Other cup holders have to be manufactured in different sizes or must be adjusted in order to fit different cup sizes. The secure adhesive attachment in my cup wrap also lets the person set the cup down repeatedly without concern about a cup holder slipping off the cup and allows the person to have a firmer, more positive grip on the beverage cup. This facilitates use in many automobile beverage holders because the flutes will collapse in the beverage holder and still maintain a firm hold to the cup. In addition to the remove-liner-and-stick quality of my invention, the invention also includes a method for printing on the fluted surface of the wrap before corrugation. U.S. Pat. Nos. 5,205,473 5,102,036 indicate printing is desired, they clearly indicate that they cannot print on the fluted side and only suggest printed artwork appear on the flat liner surface of the products. Furthermore, although the products in U.S. Pat. Nos. 5,425,497, 5,102,036 and 5,205,473 use recyclable material, they use more material than necessary and, therefore, are not the best products for the environment when used in large quantities across America.

SUMMARY OF THE INVENTION

The invention provides cup wraps which are environmentally friendly and easy to use. This cup wrap is made of corrugated material and is flat on one side and fluted on the other. The flat side has an adhesive strip lengthwise along the center of the wrap from one to the other end. The specially selected adhesive is covered by a removable adhesive paper liner that is removed by the user immediately before securely attaching the cup wrap to the cup. The flutes act as a thermal barrier between a hot cup, and the user's hand. The fluted side does not contact the cup when attached and is visible, so our method for printing on the fluted side is beneficial in marking the product for advertising and enhanced-appearance purposes. The cup wraps are easy to store by stacking them one on top of the other. The grip of the flutes are easy and comfortable to hold. The two most unique features of this product are that it will wrap many cup sizes because it does not need to completely encircle the cup's circumference. The adhesive holds the cup wrap firmly to the cup and prevents the cup wrap from slipping or falling from the placement on the paper cup.

BRIEF DESCRIPTION OF THE DRAWINGS

FIG. 1 is a front view of the cup wrap in combination with the cup displaying that the cup wrap encircles only a large portion of the circumference of the cup, but that the cup wrap does not need to connect ends of the cup wrap to hold to the cup.

FIG. 2 is a top cutaway view of the cup wrap in combination with the cup.

FIG. 3 is the flat liner side of the cup wrap. This side of the cup wrap has an adhesive tape strip in the center along the length of the wrap. The elongated octagonal shaped cup wrap or simply cup wrap has four 27° angles with impressed lines adjacent to two of these 27° angles.

FIG. 4 is the fluted side of the cup wrap. The elongated octagonal shaped cup wrap or simply cup wrap has four 27° angles with impressed lines adjacent to two of these 27° angles. This side may be printed upon before corrugation for appearance purposes.

DETAILED DESCRIPTION

With reference to FIG. 1, the cup wrap 34 is shown in combination with the cup 14. The cup 14 is more often tapered and has a base 16 and a rim 12. The cup wrap 34 is shown attached to the cup 14 wherein the cup wrap 34 does not fully encircle the circumference of the cup 14. The fact that the cup wrap 34 does not fully encircle the circumference of the cup 14 is shown by the gap 8 between the ends of the cup wrap 34. The size of the gap 8 will vary depending upon the size of the cup 14. A larger size cup 14 will result in a larger gap 8.

With reference to FIG. 2, the cup 14 is shown in a top view cutaway to describe other components of the cup wrap 34. The fluted surface 4 comprises the entire outside surface of the cup wrap 34. The open air area between the fluted surface 4 and the flat liner 2 acts as a ventilation area for air to circulate. The deep impression areas 18 of the fluted surface 4 is held at connection locations 32 by a recyclable starch adhesive to flat surface 2 on the cup wrap 34 during manufacture of the corrugated material. The inner ring 30 of the cup 14 is shown as a complete circle in the center of the cup 14. The combination of the cup 14 and the cup wrap 34 are held together by an adhesive tape strip 26 which is the length of the cup wrap 34. There is a gap 8 between the ends of the cup wrap 34 when the cup wrap 34 is attached to the cup 14. In this assembled state, the gap 8 will be larger or smaller depending on the size of the cup 14.

With reference to FIG. 3, the cup wrap 34 is show laying flat with the flat liner surface 2 face up in its complete form before being attached to a cup in normal use by the user. The flat surface 2 has 27° angles 6 cut at each corner of the cup wrap 34. At the center of the flat surface 2 is a paper liner 28 and an adhesive 26 beneath the liner 28. Both liner 28 and adhesive 26 run the entire length of the flat surface 2 and liner 28 is removable and recyclable. When the liner 28 is removed, exposed is the adhesive 26. Impressed lines 10 are made at two of the four comers to allow easy folding of the resulting triangular shapes on the impressed lines 10. This folding action will partially release the removable tape liner 28 at the location of the fold 10. The cup wrap 34 may then be attached to a paper cup 14 by contacting the flat surface 2 which includes an exposed adhesive surface 26 with the outside surface of the cup 14. This figure describes the shape of the flat, laid out cup wrap 34 as having a length 24 and height 36. The height of the cup wrap 34 is a reduced height 38 at each end of the cup wrap 34. These aforementioned dimensions and the shape may be altered without detracting from the original utility of the invention.

With reference to FIG. 4, the cup wrap 34 is show laying flat with the fluted liner surface 4 face up in its complete form before being attached to a cup in normal use by the user. The fluted surface 4 has 27° angles 6 cut at each corner of the cup wrap 34. Impressed lined 10 are made at two of the four comers to allow easy folding of the resulting triangular shapes on the impressed lines 10. This figure describes the shape of the flat, laid out cup wrap 34 as having a length 24 and height 36. The height of the cup wrap 34 is a reduced height 38 at each end of the cup wrap 34. These aforementioned dimensions and the shape may be altered without detracting from the original utility of the invention.

The materials that make up the invention are liners with the properties of being recycled or recyclable paper. These liners are assembled in a corrugation process wherein a flat liner is adjoined to a fluted liner using a recyclable starch adhesive. This corrugated material is commonly found in the manufacture of corrugated boxes, corrugated rolls or corrugated sheets and can vary in size of fluting and general dimensions in manufacture. The invention further includes printing on the fluted liner before fluting and subsequent adjoining to the flat liner. The printing is applied at an increased horizontal scale to result in a normal size printed image following the horizontal compression due to the fluting process in corrugation. The corrugated material has the properties of being absorbent. The corrugated material also has the property of being flexible to easily form to uneven surfaces such as that of a paper cup.

This invention uses an additional exposable strip of adhesive that holds special properties such as being of an acrylic or other material that adheres effectively to paper cups at temperatures ranging from the temperature of a cold beverage to the temperature of a very hot beverage (approaching 100° C.). Although the adhesive is aggressive, in its initial use it may be removed and reapplied to adjust the position of the cup wrap on the paper cup. The combination of the corrugated material and user-exposed adhesive tape strip result in a device that securely attaches to a cup and that provides the user with a thermal barrier. The device leaves a portion of the cup's circumference uncovered to an extent depending upon the size of the cup. This uncovered area (gap) illustrates that the cup wrap does not need to connect to itself at its ends and allows a single size of cup wrap to fit nearly any size beverage cup.

It is pleasing to look at because of its natural color and shape. It may be dyed different colors to suit the purchasers desires and it also may be printed upon with advertising markings or logo artwork.

The corrugated material and the adhesive tape are available at costs that allow the cup wrap to be manufactured at a competitive market price.

I claim:

1. An insulating cup holder comprising a flexible planar insulating member configured to a length and width that facilitates covering at least 50 percent and less than 100 percent of the circumference of the outside surface of a cup, said insulating member having an inner surface and an outer surface; and an exposable adhesive layer on the inner surface of said insulating member that facilitates affixing said insulating member to the cup.

2. The cup holder of claim 1, wherein said insulating member is composed of cellulosic material.

3. The cup holder of claim 2, wherein said cellulosic material is a corrugated material defined as at least two attached layers comprising a first flat layer forming the inner surface of said insulating member and a second layer which is fluted for containing insulating air.

4. The cup holder of claim 1, wherein said exposable adhesive layer comprises an acrylic adhesive material covered entirely by a removable liner, which adhesive layer is configured to cover a sufficient area of said inner surface of said insulating member to facilitate sufficient adhesion to securely attach said cup holder to the cup.

5. The cup holder of claim 1, wherein said exposable adhesive layer comprises a rubber adhesive material covered entirely by a removable liner, which adhesive layer is configured to cover a sufficient area of said inner surface of said insulating member to facilitate sufficient adhesion to securely attach said cup holder to the cup.

6. The cup holder of claim 1, wherein said exposable adhesive layer comprises a starch adhesive material covered entirely by a removable liner, which adhesive layer is configured to cover a sufficient area of said inner surface of said insulating member to facilitate sufficient adhesion to securely attach said cup holder to the cup.

7. A beverage cup and insulating cup holder combination comprising a beverage cup;

a flexible planar insulating member configured to a length and width that facilitates covering at least 50 percent and less than 100 percent of the circumference of the outside surface of the cup, said insulating member having an inner surface and an outer surface; and an adhesive layer on the inner surface of said insulating member that affixes said insulating member to the cup.

8. The beverage cup and insulating cup holder of claim 7, wherein said insulating member is composed of cellulosic material.

9. The beverage cup and insulating cup holder of claim 8, wherein said cellulosic material is a corrugated material defined as at least two attached layers comprising a first flat layer forming the inner surface of said insulating member and a second layer which is fluted for containing insulating air.

10. The beverage cup and insulating cup holder of claim 7, wherein said adhesive layer comprises an acrylic adhesive material configured to cover a sufficient area of said inner surface of said insulating member to facilitate sufficient adhesion to securely attach said cup holder to the cup.

11. The beverage cup and insulating cup holder of claim 7, wherein said adhesive layer comprises a rubber adhesive material configured to cover a sufficient area of said inner surface of said insulating member to facilitate sufficient adhesion to securely attach said cup holder to the cup.

12. The beverage cup and insulating cup holder of claim 7, wherein said adhesive layer comprises a starch adhesive material configured to cover a sufficient area of said inner surface of said insulating member to facilitate sufficient adhesion to securely attach said cup holder to the cup.

* * * * *